United States Patent [19]

Biërmans

[11] Patent Number: 4,937,876

[45] Date of Patent: Jun. 26, 1990

[54] IN-THE-EAR HEARING AID

[75] Inventor: Jan Biërmans, Eindhoven, Netherlands

[73] Assignee: U.S. Philips Corporation, New York, N.Y.

[21] Appl. No.: 412,025

[22] Filed: Sep. 25, 1989

[30] Foreign Application Priority Data

Sep. 26, 1988 [NL] Netherlands ..... 8802355

[51] Int. Cl.[5] ..... H04R 25/02

[52] U.S. Cl. ..... 381/68.6; 181/130; 181/135

[58] Field of Search ..... 381/68.6, 68; 181/130, 181/135

[56] References Cited

U.S. PATENT DOCUMENTS 3,345,737 10/1967 Gordon ..... 381/68
3,496,306 2/1970 Pollak ..... 381/68.6
4,539,440 9/1985 Sciarra ..... 381/68.6

FOREIGN PATENT DOCUMENTS 263667 4/1988 European Pat. Off. ..... 381/68
2949992 7/1980 Fed. Rep. of Germany ..... 381/68
8428887 1/1985 Fed. Rep. of Germany .
3413067 5/1985 Fed. Rep. of Germany .
8713595 1/1988 Fed. Rep. of Germany .

OTHER PUBLICATIONS

WO87/07465, "Mass Production Auditory Canal Hearing Aid", Barry Varoba, Dec. 1987.

*Primary Examiner*—Jin F. Ng
*Assistant Examiner*—Danita R. Byrd
*Attorney, Agent, or Firm*—Brian J. Wieghaus

[57] ABSTRACT

An in-the-ear hearing aid comprises a first unit (1), which unit comprises a microphone (3), an amplifier (4), controller (6) for adjusting a parameter of the hearing aid, and a battery compartment (5), and a second unit (2) comprising a receiver. The first unit (1) is accommodated in a first space situated at the end of comparatively large cross-section of an earmould (11). The second unit (2) is accommodated in a second space (9) situated at the end (13) of smaller cross-section. The earmold has a cap element (14) which allows for insertion of the second unit (2) into the second space (9) from the end (13) of smaller cross-section.

17 Claims, 1 Drawing Sheet

IN-THE-EAR HEARING AID

BACKGROUND OF THE INVENTION

The invention relates to an in the ear hearing aid, comprising a first unit which comprises a microphone, an amplifier, control means for adjusting a parameter of the hearing aid, and a battery compartment, and a second unit which comprises a receiver, the hearing aid further comprising electrical connection means for electrically connecting an output of the amplifier to an input of the receiver, the first and the second unit being accommodated in an earmould whose external shape is substantially adapted to the interior of the ear of the user of the hearing aid and which for this purpose has a substantially tapered shape, viewed in the longitudinal direction of the earmould. Such custom made hearing aids are known, for example from German Gebrauchsmuster 87.13.595. Said document describes a method of manufacturing an earmould.

An impression of the interior of the ear is made. After this, a negative in the form of a molding die is made of this impression. Subsequently, both units are inserted into the molding die via the end of larger cross-section and a liquid plastics is introduced into the molding die. When the plastics has cured the earmould is ready. Thus, both units are encapsulated in the earmould. A disadvantage of such a method is that a replacement of, for example, the receiver is not possible. Moreover, an adaptation to comparatively small ear cavities is not readily possible.

Another method of manufacturing an earmould is to introduce a liquid plastics into the molding die while the two units have not yet been inserted into the molding cavity. After partial curing the plastics which has not yet cured is removed from the molding die. A more or less cured layer of plastics is then left on the wall of the molding die. After complete curing, for example under the influence of heat or under influence of (U.V.) light, the hollow earmould can be removed from the molding die. After a finishing treatment of the untreated earmould the first and second unit can be introduced via the end of larger cross-section. The receiver is introduced first and is slid towards the end of smaller cross-section, where it is secured in the earmould. After this the first unit is mounted in the earmould. This method also has the disadvantage that it cannot readily be adapted to comparatively small ear cavities.

SUMMARY OF THE INVENTION

It is an object of the invention to provide an in-the-ear hearing aid which can more readily be adapted to comparatively small ear cavities.

To this end, the in-the-ear hearing aid in accordance with the invention is characterized in that the earmould has a first space situated at the end of comparatively large cross-section to accommodate the first unit, and a space situated at the end of smaller cross-section to accommodate the second unit, and in that the earmould comprises means for inserting the second unit into the second space from the end of smaller cross-section.

The invention is based on the recognition of the fact that in the second method described above the receiver should be inserted into the earmould from the end of larger cross-section. However, sometimes a constriction and/or kink may be formed somewhere halfway the length of the cavity in the earmould where the cross-section is so small or the shape is such that it is not possible to insert the second unit (the receiver) deeper into the cavity, although there is in fact enough space after the cavity or kink to accommodate the second unit. If the receiver is now inserted from the other end it is yet possible to insert both units into the earmould cavity.

The two cavities in the earmould may be contiguous. In that case the electrical connection means can extend between the two spaces via the coupling space. Alternatively, the two spaces may also be completely separated from one another. In that case the electrical connection means are at least partly encapsulated in the earmould.

The means may be formed in that the second space has an aperture for the passage of the second unit, which aperture is situated at the end of smaller cross-section and can be closed by means of a cap. The second space then opens towards the end of smaller cross-section, so that the second unit can be inserted via the aperture, after which the space is closed by a cap.

The cap may be formed with an aperture which is acoustically coupled to a sound outlet aperture of the receiver. A cerumen protection seal may be arranged over the aperture.

The first and the second space can be formed by a first and a second housing respectively, which are encapsulated in the earmould. During manufacture of the earmould both housings are placed in the molding die, after which the space around the housings in the die is filled.

The in-the-ear hearing aid in accordance with the invention may be characterized further in that the first space accommodates a first connector unit belonging to the electrical connection means and the second space accommodates a second connector unit belonging to the electrical connection means, in that the first connector unit is constructed to cooperate electrically with a third connector unit, after the first unit has been mounted in the first space, which third connector unit belongs to the first unit and is electrically coupled to the output of the amplifier, in that the second connector unit is constructed to cooperate electrically with a fourth connector unit, after the second unit has been mounted in the second space, which fourth connector unit belongs to the second unit and is electrically coupled to an input of the receiver, and in that the first and the second connector unit are electrically coupled to each other. This enables the electrical connection between the output of the amplifier and the input of the receiver to be realized very simply. Moreover, it is possible to define standard positions for the connector units on the various parts, resulting in a simple interchangeability of the first and second unit in an earmould.

BRIEF DESCRIPTION OF THE DRAWINGS

Embodiments of the invention will now be described in more detail, by way of example, with reference to the drawings. In the drawings

DESCRIPTION OF THE PREFERRED EMBODIMENTS

Figure 1:
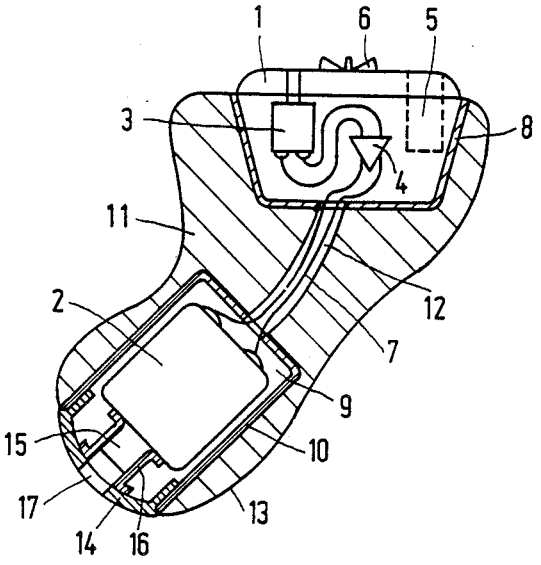
FIG. 1 shows a first embodiment.

FIG. 1 shows an embodiment comprising a first unit 1 and a second unit 2. The first unit comprises a microphone 3, an amplifier 4, a battery compartment 5 for accommodating a battery, and control means 6 for adjusting a parameter of the hearing aid. Said control means include the on/off switch, in which case the parameter is "power on/power off", and/or the volume control of the hearing aid, in which case the parameter is the gain factor of the amplifier 4. All the elements in the first unit 1 are shown only diagrammatically. The output of the amplifier 4 is electrically coupled to an input of the receiver via electrical connection means 7, which receiver forms part of the second unit 2. The first unit 1 is arranged in a first space. This space is bounded by a housing (envelope) 8. The second unit 2 is accommodated in a second space 9. This second space 9 is formed by a housing (envelope) 10. The units are incorporated in an earmould 11, in which the housings 8 and 10 are encapsulated.

The connection means 7 extend through a duct 12 in the earmould 11, via which duct the first and the second space communicate with one another.

The earmould 11 is provided with means for inserting the second unit 2 into the second space 9 from the end 13 of the earmould 11. For this purpose a cap 14, which forms part of said means is fitted into an aperture of the second space 9. When the cap has been removed the second unit 2 can be inserted into or removed from the space 9. The sound outlet aperture 15 of the receiver 2 is acoustically coupled to an aperture 17 in the cap 14 via an acoustic tube 16.

During the manufacture of the custom made earmould 11 both housings 8 and 10 are molded in, including the duct 12 for the electrical connection means 7. Prior to insertion of the two units into the earmould the connection means 7 are for example soldered to the output of the amplifier 4 and the wires are passed through the duct 12 during insertion of the first unit 1. Subsequently the electrical connection with the receiver 2 is made by soldering, after which the receiver 2 can be mounted in the second space 9. Obviously, the connections can also be made by means of (separate) connectors.

Figure 2:
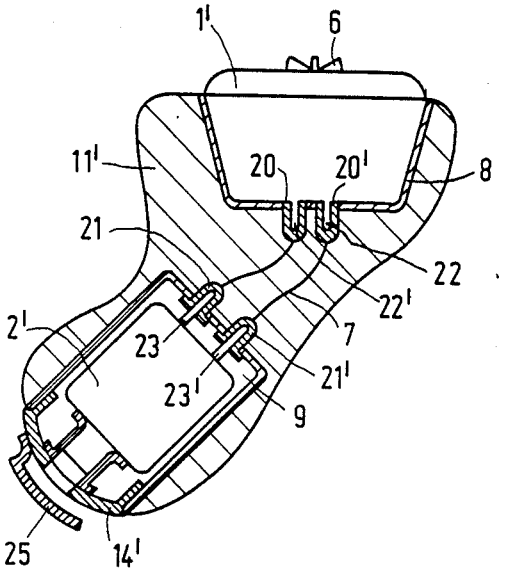
FIG. 2 shows a second embodiment.

FIG. 2 shows an embodiment which bears much resemblance to the embodiment shown in FIG. 1. Like reference numerals in FIGS. 1 and 2 refer to similar elements. If corresponding elements in the two Figures differ slightly from one another the relevant elements in FIG. 2 bear the same reference numerals but primed.

In the present case the electrical connection means 7 are encapsulated and coupled to connector units 20, 20' and 21, 21' respectively, which are also encapsulated in the earmould 11'. The first unit 1' comprises a connector unit 22, 22', which cooperates electrically with the connector unit 20, 20' after mounting of the unit 1' in the first space of the earmould 11'. The second unit 2' comprises a connector unit 23, 23', which cooperates electrically with the connector unit 21, 21' after the unit 2' has been mounted in the space 9.

Moreover, the cap 14' is now provided with a cerumen protection seal 25.

It is to be noted that the invention is not limited to the embodiments described herein. The invention also applies to those embodiments which differ from the embodiments shown in respects which are not relevant to the inventive idea.

I claim:

1. An in-the-ear hearing aid, comprising a first unit which comprises a microphone, an amplifier, control means for adjusting a parameter of the hearing aid, and a battery compartment, and a second unit which comprises a receiver, the hearing aid further comprising electrical connection means for electrically connecting an output of the amplifier to an input of the receiver, the first and the second unit being accommodated in an earmould whose external shape is substantially adapted to the interior of the ear of the user of the hearing aid and which for this purpose has a substantially tapered shape, viewed in the longitudinal direction of the earmould, characterized in that the earmould has a first space situated at the end of comparatively large cross-section to accommodate the first unit, and a space situated at the end of smaller cross-section to accommodate the second unit, and in that the earmould comprises means for inserting the second unit into the second space from the end of smaller cross-section.

2. An in-the-ear hearing aid as claimed in claim 1, characterized, in that the means are formed in that the second space has an aperture for the passage of the second unit, which aperture is situated at the end of a smaller cross-section and can be closed by means of a cap.

3. An in-the-ear hearing aid as claimed in claim 2, characterized in that the first space and the second space are formed by a first housing and a second housing respectively which are encapsulated in the earmould.

4. An in-the-ear hearing aid as claimed in claim 3, characterized in that the first unit and the second unit are accommodated in the first and the second housing relatively so as to be detachable.

5. An in-the-ear hearing aid as claimed in claim 4, characterized in that the first space accommodates a first connector unit belonging to the electrical connection means and the second space accommodates a second connector unit belonging to the electrical connection means, in that the first connector unit is constructed to cooperate electrically with a third connector unit, after the first unit has been mounted in the first space, which third connector unit belongs to the first unit and is electrically coupled to the output of the amplifier, in that the second connector unit is constructed to cooperate electrically with a fourth connector unit, after the second unit has been mounted in the second space, which fourth connector unit belongs to the second unit and is electrically coupled to an input of the receiver, and in that the first and the second connector unit are electrically coupled to each other.

6. An in-the-ear hearing aid as claimed in claim 5, characterized in that the cap is formed with an aperture which is acoustically coupled to a sound outlet aperture of the receiver.

7. An in-the-ear hearing aid as claimed in claim 6, characterized in that the cap is provided with a cerumen protection seal.

8. An in-the-ear hearing aid as claimed in claim 1, characterized in that the first space and the second space are formed by a first housing and a second housing respectively which are encapsulated in the earmould.

9. An in-the-ear hearing aid as claimed in claim 8, characterized in that the first space accommodates a first connector unit belonging to the electrical connection means and the second space accommodates a second connector unit belonging to the electrical connection means, in that the first connector unit is constructed to cooperate electrically with a third connector unit, after the first unit has been mounted in the first space, which third connector unit belongs to the first unit and is electrically coupled to the output of the amplifier, in that the second connector unit is constructed to cooperate electrically with a fourth connector unit, after the second unit has been mounted in the second space, which fourth connector unit belongs to the second unit and is electrically coupled to an input of the receiver, and in that the first and the second connector unit are electrically coupled to each other.

10. An in-the-ear hearing aid as claimed in claim 9, characterized in that the cap is formed with an aperture which is acoustically coupled to a sound outlet aperture of the receiver.

11. An in-the-ear hearing aid as claimed in claim 3, characterized in that the first space accommodates a first connector unit belonging to the electrical connection means and the second space accommodates a second connector unit belonging to the electrical connection means, in that the first connector unit is constructed to cooperate electrically with a third connector unit, after the first unit has been mounted in the first space, which third connector unit belongs to the first unit and is electrically coupled to the output of the amplifier, in that the second connector unit is constructed to cooperate electrically with a fourth connector unit, after the second unit has been mounted in the second space, which fourth connector unit belongs to the second unit and is electrically coupled to an input of the receiver, and in that the first and the second connector unit are electrically coupled to each other.

12. An in-the-ear hearing aid as claimed in claim 2, characterized in that the first space accommodates a first connector unit belonging to the electrical connection means and the second space accommodates a second connector unit belonging to the electrical connection means, in that the first connector unit is constructed to cooperate electrically with a third connector unit, after the first unit has been mounted in the first space, which third connector unit belongs to the first unit and is electrically coupled to the output of the amplifier, in that the second connector unit is constructed to cooperate electrically with a fourth connector unit, after the second unit has been mounted in the second space, which fourth connector unit belongs to the second unit and is electrically coupled to an input of the receiver, and in that the first and the second connector unit are electrically coupled to each other.

13. An in-the-ear hearing aid as claimed in claim 1, characterized in that the first space accommodates a first connector unit belonging to the electrical connection means and the second space accommodates a second connector unit belonging to the electrical connection means, in that the first connector unit is constructed to cooperate electrically with a third connector unit, after the first unit has been mounted in the first space, which third connector unit belongs to the first unit and is electrically coupled to the output of the amplifier, in that the second connector unit is constructed to cooperate electrically with a fourth connector unit, after the second unit has been mounted in the second space, which fourth connector unit belongs to the second unit and is electrically coupled to an input of the receiver, and in that the first and the second connector unit are electrically coupled to each other.

14. An in-the-ear hearing aid as claimed in claim 4, characterized in that the cap is formed with an aperture which is acoustically coupled to a sound outlet aperture of the receiver.

15. An in-the-ear hearing aid as claimed in claim 3, characterized in that the cap is formed with an aperture which is acoustically coupled to a sound outlet aperture of the receiver.

16. An in-the-ear hearing aid as claimed in claim 2, characterized in that the cap is formed with an aperture which is acoustically coupled to a sound outlet aperture of the receiver.

17. An in-the-ear hearing aid as claimed in claim 1, characterized in that the cap is formed with an aperture which is acoustically coupled to a second outlet aperture of the receiver.

* * * * *